US012297835B2

(12) United States Patent
Yang et al.

(10) Patent No.: US 12,297,835 B2
(45) Date of Patent: May 13, 2025

(54) SCREW COMPRESSOR, REFRIGERATION SYSTEM, AND METHOD FOR CONTROLLING REFRIGERATION SYSTEM

(71) Applicants: Johnson Controls Air Conditioning and Refrigeration (Wuxi) Co., Ltd., Wuxi (CN); Johnson Controls Tyco IP Holdings LLP, Milwaukee, WI (US)

(72) Inventors: Shengmei Yang, Wuxi (CN); Li Wang, Wuxi (CN); Kun Lin, Wuxi (CN); Zhengxiang Yu, Wuxi (CN)

(73) Assignees: JOHNSON CONTROLS AIR CONDITIONING AND REFRIGERATION (WUXI) CO., LTD., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/917,535

(22) PCT Filed: Apr. 6, 2021

(86) PCT No.: PCT/CN2021/085653
§ 371 (c)(1),
(2) Date: Oct. 6, 2022

(87) PCT Pub. No.: WO2021/204112
PCT Pub. Date: Oct. 14, 2021

(65) Prior Publication Data

US 2023/0138965 A1 May 4, 2023

(30) Foreign Application Priority Data

Apr. 9, 2020 (CN) ..... 202010273388.8

(51) Int. Cl.
*F04C 29/06* (2006.01)
*F04C 18/16* (2006.01)
(Continued)

(52) U.S. Cl.
CPC ..... *F04C 29/065* (2013.01); *F04C 18/16* (2013.01); *F04C 28/28* (2013.01); *F04C 29/02* (2013.01);
(Continued)

(58) Field of Classification Search
CPC ..... F04C 18/16; F04C 28/28; F04C 29/02; F04C 29/061; F04C 29/065; F04C 29/068;
(Continued)

(56) References Cited

U.S. PATENT DOCUMENTS 9,140,260 B2 9/2015 Huang et al.
9,243,557 B2 1/2016 Huang et al.
2004/0040332 A1* 3/2004 Roelke ..... F04C 29/0007 62/505

FOREIGN PATENT DOCUMENTS

CN 1811189 A 8/2006
CN 102434337 A 5/2012
(Continued)

OTHER PUBLICATIONS

English Translation of CN-109210125-A (Year: 2019).*
(Continued)

*Primary Examiner* — Anthony Ayala Delgado
(74) *Attorney, Agent, or Firm* — Fletcher Yoder, PC

(57) ABSTRACT

Disclosed is a screw compressor (100), comprising a screw compressor housing (101), a discharge cavity (113), at least one silencing channel, and at least one adjustment piston, wherein the discharge cavity (113) is defined by at least one part of the screw compressor housing (101); the at least one
(Continued)

part of the screw compressor housing (101) defining the discharge cavity (113) forms a wall of the discharge cavity (113); at least one hole is provided in the wall of the discharge cavity (113); the at least one adjustment piston can be inserted into the at least one hole and move therein; the at least one silencing channel is formed by the at least one hole and the at least one adjustment piston, and the at least one silencing channel is in fluid communication with the discharge cavity (113); and the position of the at least one adjustment piston in the at least one hole determines the silencing length of the at least one silencing channel.

13 Claims, 11 Drawing Sheets

(51) Int. Cl.

| | |
|---|---|
| ***F04C 28/28*** | (2006.01) |
| ***F04C 29/02*** | (2006.01) |
| ***F04C 29/12*** | (2006.01) |
| ***F25B 1/047*** | (2006.01) |
| ***F25B 31/00*** | (2006.01) |
| ***F25B 49/02*** | (2006.01) |

(52) U.S. Cl.
CPC ..... *F04C 29/12* (2013.01); *F25B 1/047* (2013.01); *F25B 31/002* (2013.01); *F25B 49/022* (2013.01)

(58) Field of Classification Search
CPC ..... F04C 29/12; F25B 1/047; F25B 2500/12; F25B 2600/25; F25B 31/002; F25B 31/004; F25B 49/02; F25B 49/022
See application file for complete search history.

(56) References Cited

FOREIGN PATENT DOCUMENTS

| | | | | | |
|---|---|---|---|---|---|
| CN | 202326259 | U | | 7/2012 | |
| CN | 204402717 | U | | 6/2015 | |
| CN | 107165825 | A | | 9/2017 | |
| CN | 107654272 | A | | 2/2018 | |
| CN | 109162920 | A | | 1/2019 | |
| CN | 109210125 | A | * | 1/2019 | ..... F16F 9/16 |
| EP | 2209968 | B1 | | 1/2018 | |
| JP | H10318175 | A | | 12/1998 | |
| TW | 200632215 | A | | 9/2006 | |
| WO | 2006096178 | A1 | | 9/2006 | |
| WO | WO-2009045187 | A1 | * | 4/2009 | ..... F04C 18/16 |
| WO | 2018037906 | A1 | | 3/2018 | |
| WO | 2018112608 | A1 | | 6/2018 | |

OTHER PUBLICATIONS

English Translation CN-109210125-A (Year: 2019).*
PCT International Search Report for PCT Application No. PCT/CN2021/085653, mailed Jun. 24, 2021, 4 pgs.
European Extended Search Report for EP Application No. 21785574.1, dated Jun. 13, 2024, 9 pages.
Taiwan Office Action and Search Report for TW Application No. 110112800, mailed on Feb. 17, 2025, 5 pages.

* cited by examiner

SCREW COMPRESSOR, REFRIGERATION SYSTEM, AND METHOD FOR CONTROLLING REFRIGERATION SYSTEM

CROSS-REFERENCE TO RELATED APPLICATIONS

This application is a U.S. National Stage Application of PCT Application No. PCT/CN2021/085653, entitled "SCREW COMPRESSOR, REFRIGERATION SYSTEM, AND METHOD FOR CONTROLLING REFRIGERATION SYSTEM," filed Apr. 6, 2021, which claims priority from and the benefit of Chinese Patent Application No. 202010273388.8, filed Apr. 9, 2020, each of which is herein incorporated by reference in its entirety for all purposes.

BACKGROUND

Technical Field

This application relates to compressors, and more specifically relates to a screw compressor.

Related Art

A compressor includes a screw compressor. The screw compressor includes a housing and a female rotor and a male rotor disposed in the housing. There is a compression cavity between the female rotor and the male rotor. During rotation of the female rotor and the male rotor, the compression cavity becomes smaller and smaller, so that the volume of a gas accommodated in the compression cavity becomes smaller, so as to increase the pressure of the gas, thereby realizing compression of the gas. In the screw compressor, there are a plurality of spaced compression cavities between the female rotor and the male rotor, and thus, the compressed gas intermittently discharged from the compression cavities acts on the housing and is delivered downstream, thereby producing airflow induced vibration and noise.

SUMMARY

According to a first aspect of this application, this application provides a screw compressor. The screw compressor includes a screw compressor housing, a discharge cavity, at least one silencing channel and at least one adjustment piston. The discharge cavity is defined by at least one part of the screw compressor housing, the at least one part of the screw compressor housing defining the discharge cavity forms a wall of the discharge cavity, and at least one hole is provided in the wall of the discharge cavity. The at least one adjustment piston can be inserted into the at least one hole and can move therein. The at least one silencing channel is formed by the at least one hole and the at least one adjustment piston, and the at least one silencing channel is in fluid communication with the discharge cavity. A position of the at least one adjustment piston in the at least one hole determines a silencing length of the at least one silencing channel.

According to the screw compressor of the first aspect of this application, the at least one silencing channel is at least two silencing channels, and the at least one adjustment piston is at least two adjustment pistons. The screw compressor further includes an adjustment slider, and the at least two adjustment pistons are connected to the adjustment slider. The adjustment slider and the at least two adjustment pistons are configured such that each of the at least two adjustment pistons can do reciprocating movement in the corresponding silencing channel when the adjustment slider does reciprocating movement relative to the screw compressor housing, thereby changing the silencing length of each of the at least two silencing channels.

According to the screw compressor of the first aspect of this application, the at least one silencing channel is at least two silencing channels, and the at least one adjustment piston is at least two adjustment pistons. The at least two adjustment pistons can do reciprocating movement relative to the screw compressor housing independently of each other, thereby changing a silencing length of each of the at least two silencing channels.

According to the screw compressor of the first aspect of this application, the at least two adjustment pistons are configured such that each of the at least two silencing channels has a different silencing length at any moment when the at least two adjustment pistons do reciprocating movement relative to the screw compressor housing.

According to the screw compressor of the first aspect of this application, the at least one hole is provided with an inlet end and a distal end opposite to the inlet end, and the at least one adjustment piston can be inserted into the at least one hole from the distal end. The distance between a top portion of the at least one adjustment piston and the inlet end is a silencing length.

According to the screw compressor of the first aspect of this application, the at least one hole is provided with an inlet end and a distal end opposite to the inlet end, and the at least one adjustment piston can be inserted into the at least one hole from the distal end. Each of the at least one adjustment piston is provided with a recess extending from an end surface of one end of the at least one adjustment piston to the other end, and the distance between a bottom of the recess of the at least one adjustment piston and the inlet end is a silencing length.

According to the screw compressor of the first aspect of this application, the screw compressor further includes an adjustment box, and the adjustment box is arranged on an outer side of the screw compressor housing and defines an adjustment cavity. The adjustment slider is disposed in the adjustment box, and divides the adjustment cavity into a first accommodation portion and a second accommodation portion, the first accommodation portion is formed on one side of the adjustment slider close to the screw compressor housing, and the second accommodation portion is formed between the adjustment box and the adjustment slider.

According to a second aspect of this application, this application further provides a screw compressor, the screw compressor including a screw compressor housing, a discharge cavity, an adjustment box, an adjustment piston and a silencing channel. The discharge cavity is defined by at least one part of the screw compressor housing, the at least one part of the screw compressor housing defining the discharge cavity forms a wall of the discharge cavity, and a hole is provided in the wall of the discharge cavity. The adjustment box is arranged on the outer side of the screw compressor housing and defines an adjustment cavity, and the adjustment cavity and the hole form a continuous channel. The adjustment piston can be inserted into the continuous channel, and can move therein. The silencing channel is formed by the hole, the adjustment piston and the adjustment box, and the silencing channel is in fluid communication with the discharge cavity. A position of the at least one adjustment piston in the hole and the adjustment cavity determines a silencing length of the silencing channel.

According to the screw compressor of the second aspect of this application, the screw compressor further includes at least one plate, and the at least one plate is arranged in the discharge cavity and covers the hole. At least one plate is provided with several perforations so as to make the discharge cavity be in fluid communication with the silencing channel.

According to the screw compressor of the second aspect of this application, the adjustment piston is disposed in the adjustment box, and divides the adjustment cavity into a first accommodation portion and a second accommodation portion, the first accommodation portion is formed on one side of the adjustment piston close to the screw compressor housing, and the second accommodation portion is formed between the adjustment box and the adjustment piston.

According to a third aspect of this application, this application further provides a refrigeration system, the refrigeration including the screw compressor and a lubricant circuit. The lubricant circuit is connected to the screw compressor. The second accommodation portion communicates with the lubricant circuit in a closable manner, and communicates with an inlet of the screw compressor in a closable manner. The refrigeration system is configured to be capable of supplying a lubricant from the lubricant circuit to the second accommodation portion so as to make the adjustment piston move towards the inlet end, and capable of introducing the lubricant in the second accommodation portion into an inlet of the screw compressor so as to make the adjustment piston move away from the inlet end.

The screw compressor of this application can adapt to different compressor operating conditions, reducing noise.

Other features, advantages and embodiments of this application may be set forth or become apparent from consideration of the following detailed description, drawings and claims. Furthermore, it is to be understood that both the foregoing summary and the following detailed description are exemplary and intended to provide further explanation without limiting the scope of the claimed application. However, the detailed description and specific examples are only indicative of preferred embodiments of this application. Various changes and modifications within the spirit and scope of this application will become apparent to those skilled in the art from this detailed description.

BRIEF DESCRIPTION OF THE DRAWINGS

The features and advantages of this application may be better understood by reading the following detailed description with reference to the accompanying drawings, and the same reference numerals indicate the same components throughout the drawings.

DETAILED DESCRIPTION

Figure 1A:
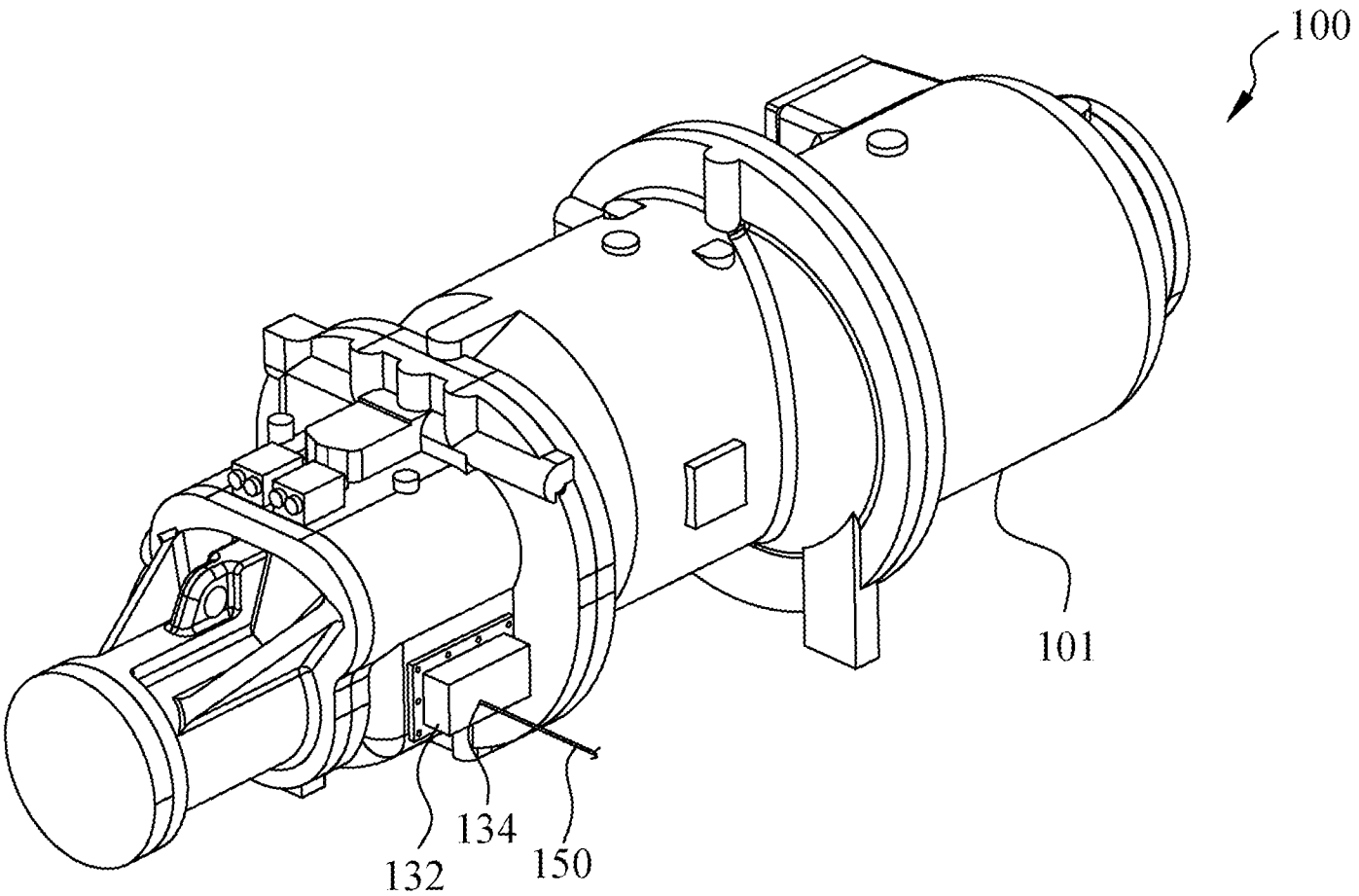
FIG. 1A is a three-dimensional view of a screw compressor from front to rear according to an embodiment of this application.

Various specific implementations of this application will be described below with reference to the accompanying drawings forming a part of this specification. It should be understood that although directional terms such as "front", "rear", "upper", "lower", "outer" and "bottom" are used in this application to describe various example structural components and elements of this application, these terms used herein are for convenience of description only, and are determined based on the exemplary orientations shown in the drawings. Since the embodiments disclosed in this application may be disposed in different directions, these directional terms are used for illustration only and should not be regarded as limiting.

Figure 1B:
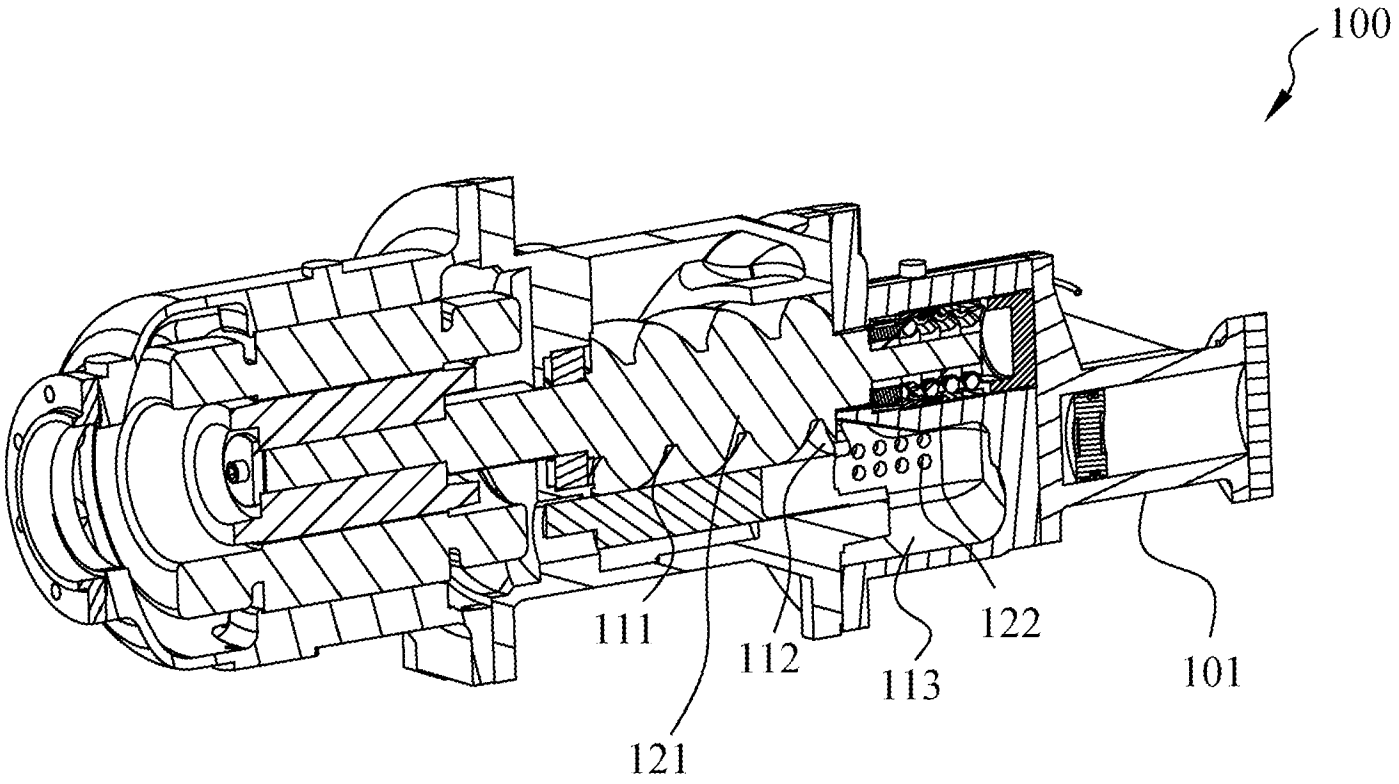
FIG. 1B is a cross-sectional view of a screw compressor shown in FIG. 1A along a length direction of the screw compressor and from rear to front.
Figure 1C:
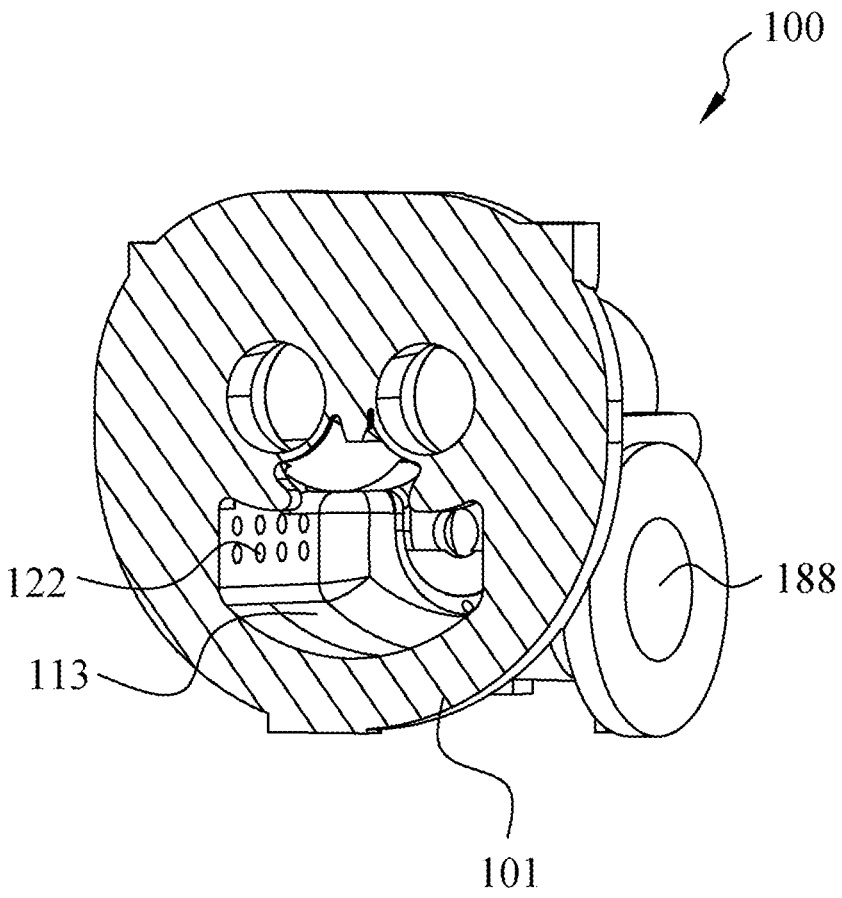
FIG. 1C is a cross-sectional view of a screw compressor shown in FIG. 1A along a width direction of the screw compressor and section-cut to a discharge cavity of the screw compressor.

FIG. 1A is a three-dimensional view of a screw compressor 100 from front to rear according to an embodiment of this application; FIG. 1B is a cross-sectional view of a screw compressor 100 shown in FIG. 1A along a length direction of the screw compressor and from rear to front; and FIG. 1C is a cross-sectional view of a screw compressor 100 shown in FIG. 1A along a width direction of the screw compressor and section-cut to a discharge cavity 113 of the screw compressor 100. As shown in FIGS. 1A to 1C, the screw compressor 100 includes a screw compressor housing 101. The screw compressor housing 101 defines a rotor cavity 111 and a discharge cavity 113. The rotor cavity 111 and the discharge cavity 113 communicate with each other via a communication port 112.

Specifically, a pair of rotors are disposed in the rotor cavity 111. The pair of rotors include a male rotor 121 and a female rotor (not shown). A compression cavity (not shown) is formed between the male rotor 121 and the female rotor, the compression cavity being enclosed by tooth surfaces of the male rotor 121 and the female rotor. The compression cavity can be in fluid communication with the discharge cavity 113 via the communication port 112. When the screw compressor 100 operates, a gas enters a compression cavity between the male rotor 121 and the female rotor from an inlet of the screw compressor 100 (see FIG. 3, i.e., a screw compressor inlet 302). As the male rotor 121 and the female rotor rotate, the compression cavity will gradually become smaller and moves towards the communication port 112. When the compression cavity moves until being in fluid communication with the communication port 112, the compressed gas in the compression cavity flows into the discharge cavity 113 via the communication port 112. Intermittently formed compressed fluid temporarily stays in the discharge cavity 113 to form a buffer, thereby forming relatively smooth airflow, flowing out of the screw compressor 100 through an outlet 188 (see FIG. 3, i.e., a screw compressor outlet 306) of the screw compressor 100 disposed on the discharge cavity 113. Eight holes 122 are provided in a wall of the discharge cavity 113, the eight holes 122 are arranged in two rows, and each row includes four holes 122. The eight holes 122 all extend through the wall of the discharge cavity 113.

As shown in FIG. 1A, the screw compressor 100 further includes an adjustment box 132. The adjustment box 132 is disposed on the screw compressor housing 101 and covers the eight holes 122. Components provided in the adjustment box 132 can fit with the eight holes 122, thereby reducing noise produced by the gas discharged from the screw compressor 100. The adjustment box 132 is provided with a communication port 134 connected with a lubricant system through a connecting pipe 150. The adjustment box 132, the components provided in the adjustment box 132 and the holes provided in the wall of the discharge cavity 113 form a silencing structure, and a specific fitting relationship of them will be described in conjunction with FIG. 2.

Figure 2:
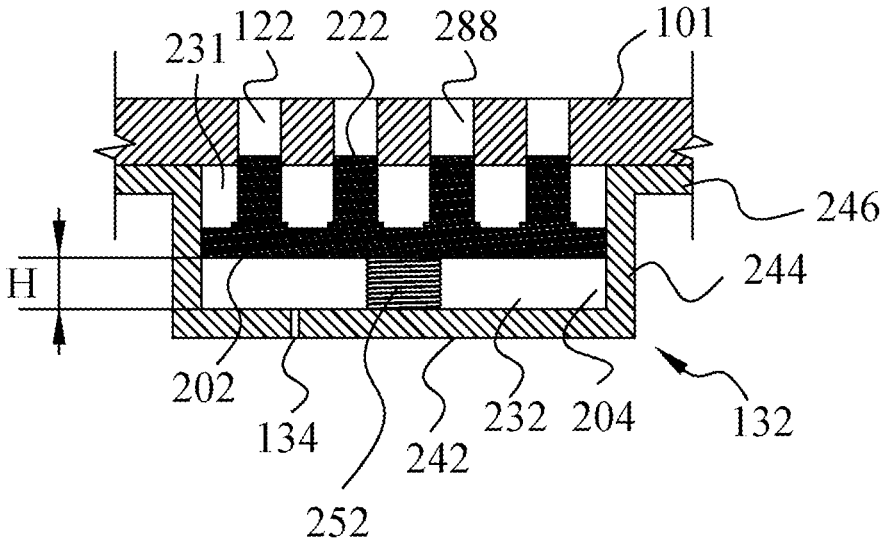
FIG. 2 is a cross-sectional view of a first embodiment of a silencing structure shown in FIG. 1A.

FIG. 2 is a cross-sectional view of a first embodiment of a silencing structure shown in FIG. 1A, so as to show the fitting relationship between the adjustment box 132, the components in the adjustment box 132 and the screw compressor housing 101. As shown in FIG. 2, the eight holes 122 are provided in the wall of the discharge cavity 113. Each of the eight holes 122 extends through the wall of the discharge cavity 113. The adjustment box 132 includes a substantially rectangular bottom wall 242, side walls 244 and connecting walls 246. The side walls 244 surround the bottom wall 242 and extend upwards from a circumferential edge of the bottom wall 242, and the connecting wall 246 extends outwards from an upper edge of the side wall 244. The adjustment box 132 is disposed on an outer side of the screw compressor housing 101 and covers the eight holes 122. The connecting wall 246 abuts against the screw compressor housing 101 and is connected with the outer side of the screw compressor housing 101 by means of connecting components (not shown) or welding or the like. The bottom wall and the side walls 244 of the adjustment box 132 enclose an adjustment cavity 204 together with the screw compressor housing 101. The adjustment cavity 204 is in fluid communication with the eight holes 122.

The screw compressor 100 further includes an adjustment slider 202 and eight adjustment pistons 222. Each of the eight adjustment pistons 222 is a cylindrical body connected with an upper surface of the adjustment slider 202, so that the adjustment slider 202 and the eight adjustment pistons 222 can move together. A shape of each of the eight adjustment pistons 222 matches a corresponding one of the eight holes 122, so that each of the eight adjustment pistons 222 can be inserted into the corresponding one of the eight holes 122. The eight adjustment pistons 222 and the eight holes 122 are further configured such that the gas in the discharge cavity 113 does not flow into the adjustment cavity 204 when the eight adjustment pistons 222 move vertically in the eight holes 122. The eight holes 122 are each provided with an inlet end and a distal end opposite to the inlet end. The inlet end is formed by walls of the eight holes 122, and is in fluid communication with the discharge cavity 113. The eight adjustment pistons 222 are inserted into the corresponding holes 122 from the distal end. The eight adjustment pistons 222 and the eight holes 122 form eight silencing channels 288, respectively. Specifically, one end of the silencing channel 288 is defined by the inlet end, and the other end thereof is defined by top portions of the eight adjustment pistons 222. When the adjustment pistons 222 moves vertically in the holes 122, the distance between the inlet end and the top portions of the eight adjustment pistons 222 changes, so that the silencing channels 288 have a different length. When a top surface of the adjustment piston 222 is flush with an inner side of the wall of the hole 122, the length of the silencing channel 288 is 0. A circumferential size of the adjustment slider 202 is configured to match the side walls 244 of the adjustment box 132, so that the adjustment cavity 204 is divided by the adjustment slider 202 into a first accommodation portion 231 and a second accommodation portion 232 separated from each other. The first accommodation portion 231 is formed on one side (i.e., an upper side of the adjustment slider 202) of the adjustment slider 202 close to the screw compressor housing 101, and the second accommodation portion 232 is formed between (i.e., a lower side of the adjustment slider 202) the adjustment slider 202 and the bottom wall 242 of the adjustment box 132.

The bottom wall 242 of the adjustment box 132 is provided with a communication port 134 for being connected with a pressure source. In an embodiment of this application, the communication port 134 is connected with a lubricant circuit through the connecting pipe 150 (see FIG. 1A), so that a lubricant can flow into the second accommodation portion 232 through the communication port 134. Pressure in the first accommodation portion 231 is substantially ambient pressure (i.e., one atmospheric pressure).

The screw compressor 100 further includes a spring 252 for providing an auxiliary force for upward (i.e., towards the screw compressor housing 101) movement of the adjustment slider 202 in the adjustment box 132, and for limiting the range of downward movement of the adjustment slider 202. Specifically, one end of the spring 252 is connected with a lower surface of the adjustment slider 202, and the other end of the spring 252 is connected with the bottom wall 242 of the adjustment box 132. When the distance between a bottom portion of the adjustment slider 202 and a top portion of the bottom wall 242 is a predetermined distance H, the spring 252 is in a free state, that is, the spring 252 is not compressed or stretched, without exerting a force on the adjustment slider 202. When the distance between the bottom portion of the adjustment slider 202 and the top portion of the bottom wall 242 is greater than the predetermined distance H, the spring 252 is stretched, exerting a downward (i.e., away from the screw compressor housing 101) pulling force on the adjustment slider 202. When the distance between the bottom portion of the adjustment slider 202 and the top portion of the bottom wall 242 is less than the predetermined distance H, the spring 252 is compressed, exerting an upward (i.e., towards the screw compressor housing 101) thrust to the adjustment slider 202.

When the screw compressor 100 operates, a refrigerant is compressed in the screw compressor 100 into a high-temperature and high-pressure gas. The compressed gas enters the discharge cavity 113, producing an exhaust pulsation with relatively high acoustic energy. The exhaust pulsation not only causes vibration and noise, but also causes a device downstream of the screw compressor 100 in a refrigeration system to form a secondary sound source.

The wall of the discharge cavity 113 of the screw compressor 100 of this application is provided with the silencing channels 288, capable of controlling propagation of the noise at a position closest to a noise-causing position. When an operating frequency, exhaust pressure, exhaust temperature and other parameters of the screw compressor 100 change, a frequency corresponding to peak energy of the exhaust pulsation of the screw compressor 100 is different, and a wavelength corresponding to its peak energy is also different. The length of the silencing channel 288 in the silencing structure of this application can be adjusted, thereby adapting to the peak wavelength under different working conditions, so as to reduce the peak energy of the exhaust pulsation and effectively perform silencing.

Figure 3:
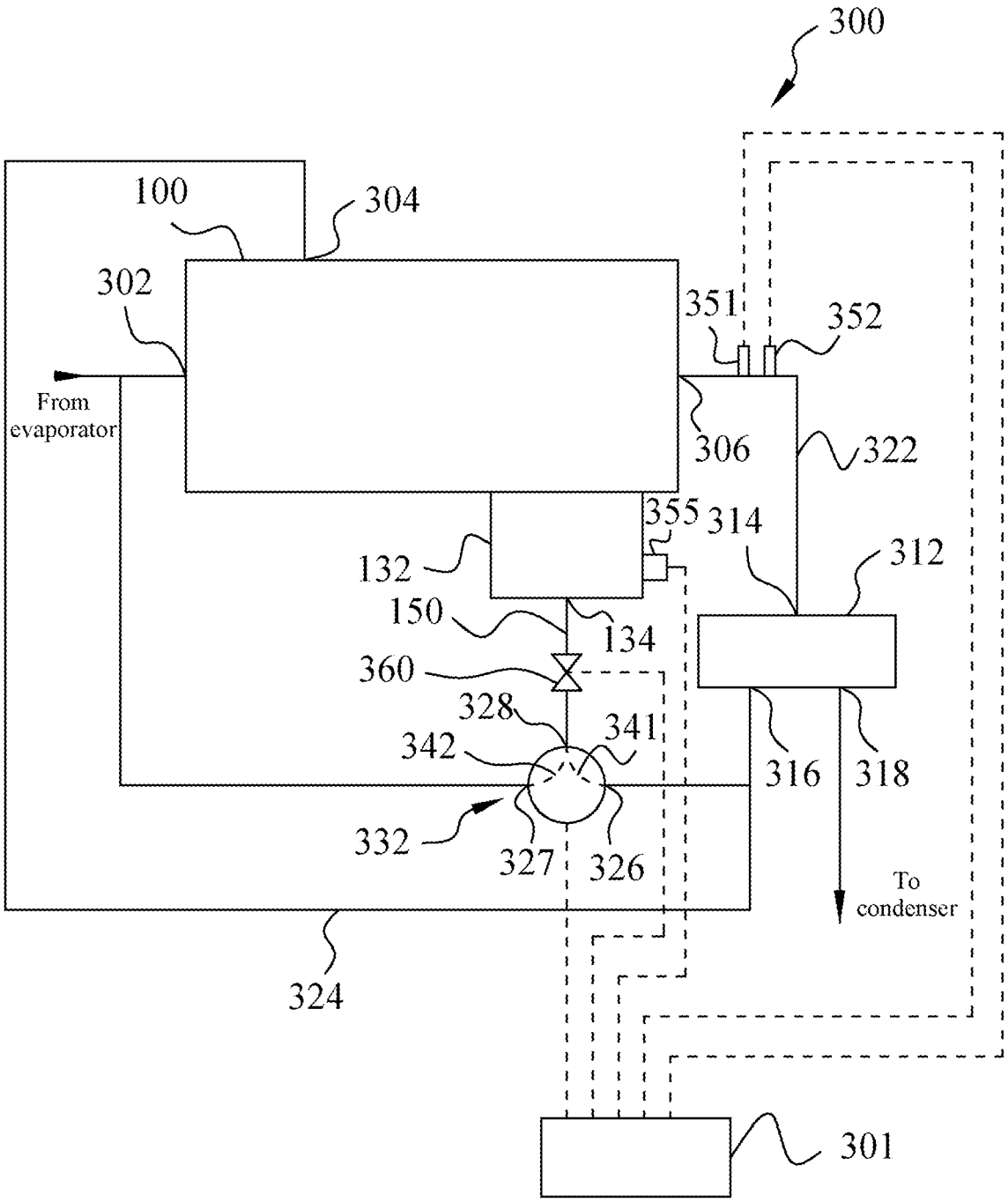
FIG. 3 is a partial system diagram of a refrigeration system using the screw compressor of this application.

FIG. 3 shows a partial system diagram of a refrigeration system 300 using a screw compressor 100 of this application. In this embodiment, the lubricant is used as a power source for driving the adjustment slider 202 and the eight adjustment pistons 222 to move.

As shown in FIG. 3, the refrigeration system 300 includes the screw compressor 100. The screw compressor 100 includes a screw compressor inlet 302, a lubricant inlet 304 and a screw compressor outlet 306. The screw compressor inlet 302 is in fluid communication with the rotor cavity 111 for receiving a refrigerant from an evaporator (not shown) of the refrigeration system 300. The lubricant inlet 304 is in fluid communication with the rotor cavity 111 for receiving a lubricant from a lubricant separating apparatus 312. The screw compressor outlet 306 is in fluid communication with the discharge cavity 113 for discharging the compressed refrigerant and lubricant out of the screw compressor 100.

The refrigeration system 300 further includes the lubricant separating apparatus 312. The lubricant separating apparatus 312 is configured to separate the refrigerant and the lubricant. Specifically, the lubricant separating apparatus 312 includes a lubricant separating apparatus inlet 314, a lubricant outlet 316 and a refrigerant outlet 318. The lubricant separating apparatus inlet 314 is connected with the screw compressor outlet 306 through a first channel 322 for receiving compressed refrigerant and lubricant. After the refrigerant and the lubricant pass through the lubricant separating apparatus 312, the lubricant flows out of the lubricant outlet 316 and the refrigerant flows out of the refrigerant outlet 318. The lubricant outlet 316 is in fluid communication with the lubricant inlet 304 of the screw compressor through a second channel 324 for introducing the lubricant into the rotor cavity 111 of the screw compressor 100, thereby lubricating the male rotor 121 and the female rotor. The refrigerant flows from the refrigerant outlet 318 to a condenser (not shown) of the refrigeration system 300. Thus, the screw compressor 100, the first channel 322, the lubricant separating apparatus 312 and the second channel 324 form the lubricant circuit.

The refrigeration system 300 further includes a switching apparatus 332. The switching apparatus 332 includes a first port 326, a second port 327, a third port 328, a switching apparatus first channel 341 and a switching apparatus second channel 342. The switching apparatus first channel 341 is configured to connect the first port 326 with the third port 328, and the switching apparatus second channel 342 is configured to connect the second port 327 with the third port 328. When the switching apparatus 332 is in a first position, the switching apparatus first channel 341 is connected while the switching apparatus second channel 342 is disconnected. When the switching apparatus 332 is in a second position, the switching apparatus first channel 341 is disconnected while the switching apparatus second channel 342 is connected. The first port 326 of the switching apparatus 332 is in fluid communication with the lubricant outlet 316 for introducing a high-pressure lubricant. The second port 327 of the switching apparatus 332 is in fluid communication with the screw compressor inlet 302 for making the high-pressure lubricant flow into the screw compressor 100. The third port 328 of the switching apparatus 332 is connected with the communication port 134 of the adjustment box 132 through the connecting pipe 150. The connecting pipe 150 is provided with a solenoid valve 360. Opening and closing of the solenoid valve 360 can be controlled, thereby controlling connection and disconnection of the connecting pipe 150.

The screw compressor 100 further includes two acoustic sensors 351 and 352. In this embodiment, the acoustic sensors 351 and 352 are arranged in the first channel 322. Detection ends (not shown) of the acoustic sensors 351 and 352 are in fluid communication with the first channel 322 so as to detect an exhaust pulsation energy value of the gas discharged from the screw compressor 100. Those skilled in the art can understand that the two acoustic sensors 351 and 352 are configured to detect the exhaust pulsation energy value of the gas discharged from the screw compressor 100, and therefore, the detection ends of the two acoustic sensors 351 and 352 can also be disposed in the discharge cavity 113.

The screw compressor 100 further includes a position sensor 355 for detecting the distance between the adjustment slider 202 and the bottom wall 242 of the adjustment box 132. Since a wall thickness of the screw compressor housing 101, the distance from the bottom wall 242 of the adjustment box 132 to the screw compressor housing 101 and lengths of the eight adjustment pistons 222 are all fixed and known, the real-time silencing length can be obtained according to the distance between the adjustment slider 202 and the bottom wall 242 of the adjustment box 132 detected by the position sensor 355.

The refrigeration system 300 further includes a controlling apparatus 301. The controlling apparatus 301 is connected with the acoustic sensors 351 and 352, the position sensor 355, the solenoid valve 360 and the switching apparatus 332 in a communicating manner. The controlling apparatus 301 can obtain the exhaust pulsation energy value of the gas discharged from the screw compressor 100 from the acoustic sensors 351 and 352, thereby working out a target silencing length. The controlling apparatus 301 can obtain the distance between the adjustment slider 202 and the bottom wall 242 of the adjustment box 132 from the position sensor 355, thereby working out a real-time silencing length. The controlling apparatus 301 can monitor the real-time silencing length, and adjust positions of the eight adjustment pistons 222 according to a relationship between the real-time silencing length and the target silencing length. For example, when the real-time silencing length is less than or greater than the target silencing length, the eight adjustment pistons 222 are moved downwards or upwards. When the real-time silencing length is equal to the target silencing length, the eight adjustment pistons 222 are made to stop moving and kept at current positions. The controlling apparatus 301 can also control opening or closing of the solenoid valve 360 and control the switching apparatus 332 to be in the first position or the second position.

Figure 4:
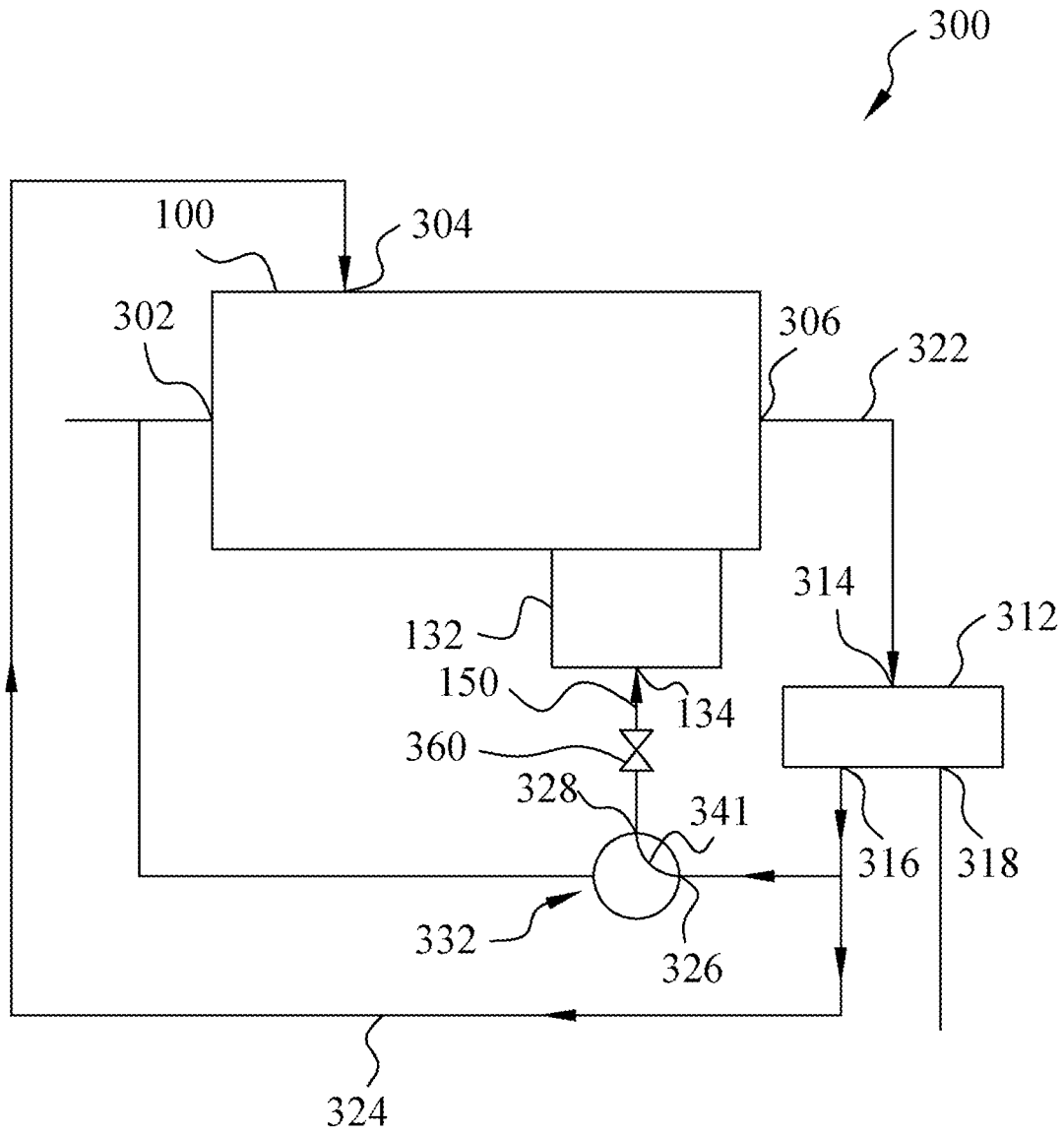
FIG. 4 is a flow path diagram of a lubricant in a refrigeration system when an adjustment slider is moved upwards.

FIG. 4 shows a flow path diagram of a lubricant in a refrigeration system 300 when an adjustment slider 202 is moved upwards. Arrows indicate a flow path of the lubricant. As shown in FIG. 4, when the adjustment slider 202 needs to move upwards, the controlling apparatus 301 switches the switching apparatus 332 to the first position, so that the first channel 341 is connected while the second channel 342 is disconnected. The controlling apparatus 301 also opens the solenoid valve 360, so that the connecting pipe 150 is communicated. In this way, the lubricant is divided into two ways after flowing out from the lubricant outlet 316 of the lubricant separating apparatus 312. One way of lubricant enters the second accommodation portion 232 through the first port 326 and the third port 328 of the switching apparatus 332 and the communication port 134 of the adjustment box 132 in sequence, thereby controlling the movement of the adjustment slider 202 and the eight adjustment pistons 222. The other way of lubricant flows by following the lubricant circuit. Specifically, the lubricant enters the screw compressor 100 through the second channel 324 from the lubricant inlet 304 of the screw compressor.

Figure 5:
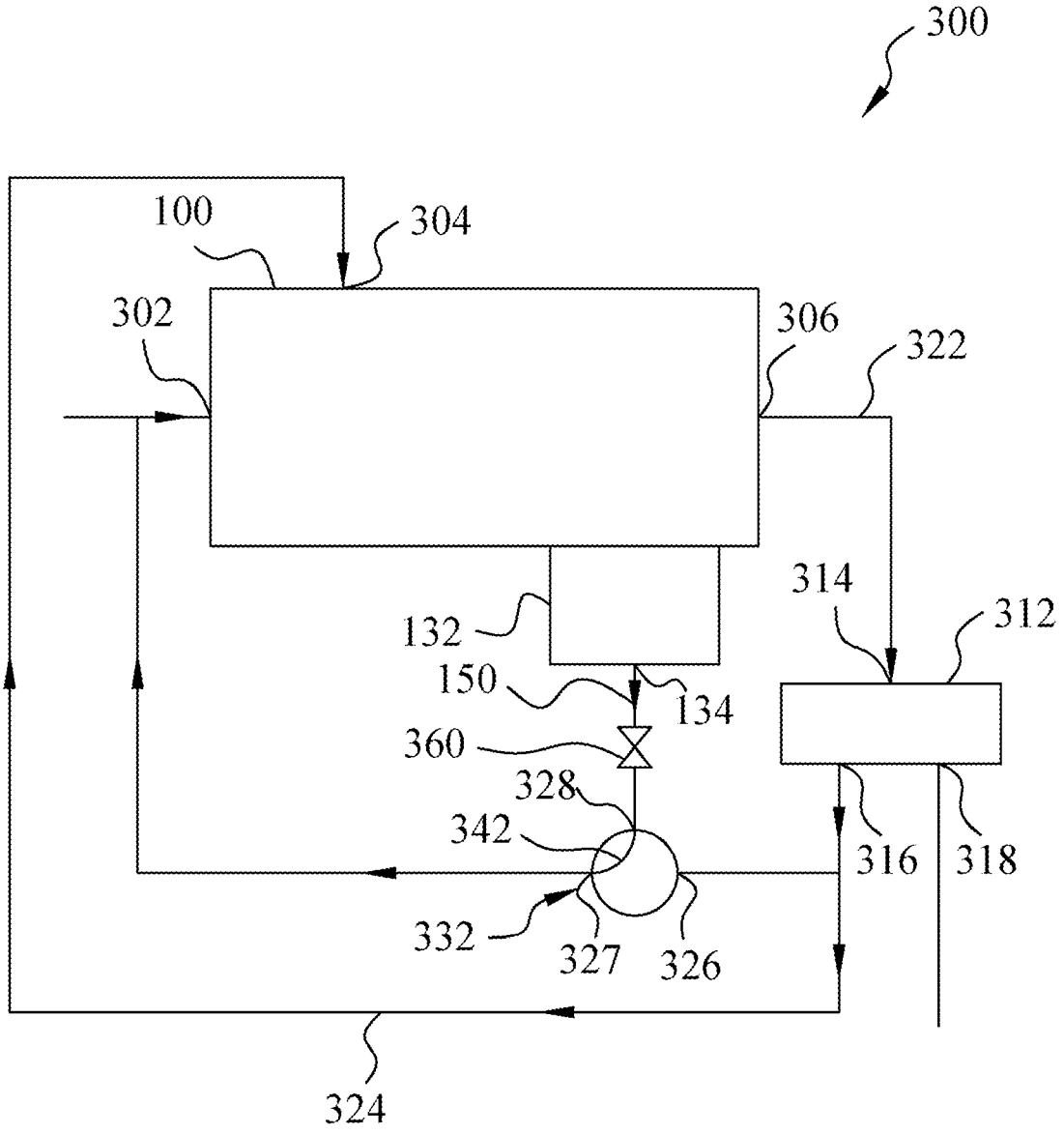
FIG. 5 is a flow path diagram of a lubricant in a refrigeration system when an adjustment slider is moved downwards.

FIG. 5 shows a flow path diagram of a lubricant in a refrigeration system 300 when an adjustment slider 202 is moved downwards. Arrows indicate a flow path of the lubricant. As shown in FIG. 5, when the adjustment slider 202 needs to move downwards, the controlling apparatus 301 switches the switching apparatus 332 to the second position, so that the second channel 342 is connected while the first channel 341 is disconnected. The controlling apparatus 301 also opens the solenoid valve 360, so that the connecting pipe 150 is communicated. In this way, in addition to the fact that one way of lubricant flows by following the lubricant circuit, the lubricant flowing out from the second accommodation portion 232 enters the screw compressor inlet 302 via the communication port 134, the third port 328 and the second port 327 of the adjustment box 132 and flows into the screw compressor 100.

Figure 6:
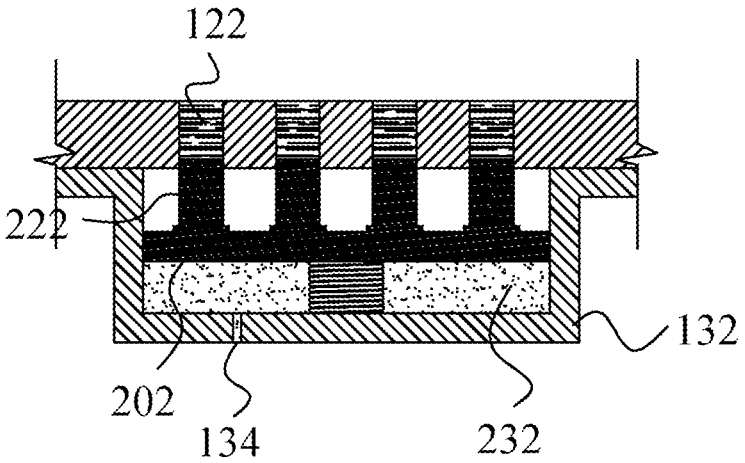
FIG. 6 is a schematic diagram of controlling movement of an adjustment slider and an adjustment piston.

FIG. 6 shows a schematic diagram of controlling movement of an adjustment slider 202 and an adjustment piston 222. As shown in FIG. 6, the eight adjustment pistons 222 and the adjustment slider 202 are connected with each other, so that the eight adjustment pistons 222 and the adjustment slider 202 can move together. Movement directions of the eight adjustment pistons 222 and the adjustment slider 202 depend on a pressure difference between upper sides and lower sides of the eight adjustment pistons 222 and the adjustment slider 202. When the switching apparatus 332 is located in the first position, the second accommodation portion 232 is filled with the high-pressure lubricant, pressure on the lower sides of the eight adjustment pistons 222 and the adjustment slider 202 is greater than that on the upper sides of the eight adjustment pistons 222 and the adjustment slider 202, and the adjustment slider 202 and the adjustment pistons 222 move upwards, thereby reducing the length of the silencing channels 288. When the switching apparatus 332 is located in the second position, the second accommodation portion 232 communicates with a low pressure end (i.e., a suction end) of the screw compressor 100, the lubricant flows out of the second accommodation portion 232, and the adjustment slider 202 and the adjustment pistons 222 move downwards, thereby increasing the length of the silencing channels 288. When the silencing length of the silencing channel 288 is equal to the target silencing length, the controlling apparatus 301 closes the solenoid valve 360, so that the adjustment slider 202 and the adjustment piston 222 are kept at current positions.

Thus, the screw compressor 100 of this application can utilize the lubricant circuit in the refrigeration system 300, and thereby, the length of the silencing channel 288 is controlled by controlling the position of the adjustment piston 222 without requiring an additional drive source.

As an example, the peak wavelength of the exhaust pulsation can be calculated by signals collected by the two acoustic sensors 351 and 352, thereby determining the length of the silencing channel 288, so as to achieve a silencing effect. Specifically, the detection ends (not shown) of the two acoustic sensors 351 and 352 are disposed in the first channel 322 so as to obtain the exhaust pulsation energy value (for example, autopower spectra, cross-power spectra). Then, spectrum data of the exhaust pulsation energy traveling downstream is obtained by the following equation:

$$pi = \sqrt{\frac{S_{11} + S_{12} - 2C_{12}\cos kx_{12} + 2Q_{12}\sin kx_{12}}{4(\sin kx_{12})^2}}$$

where, $S_{11}$ and $S_{12}$ are the autopower spectra of signals picked up at the acoustic sensors 351 and 352, $C_{12}$ and $Q_{12}$ are the cross-power spectra of the signals picked up at the acoustic sensors 351 and 352, k is a wave number, $x_{12}$ is a center distance between the acoustic sensor 351 and the acoustic sensor 352, and $p_i$ is the spectrum data of the exhaust pulsation energy.

Then, the frequency corresponding to the peak energy is extracted according to the worked out spectrum data $p_i$ of the exhaust pulsation energy, and sound velocity in an exhaust fluid is obtained from operating parameters of the screw compressor 100 (for example, the exhaust pressure, the exhaust temperature), and thereby, the wavelength corresponding to the peak energy can be worked out. The corresponding target silencing length is calculated from this wavelength. The controlling apparatus 301 controls the position of the adjustment piston 222 according to the worked out target silencing length, so that the actual length of the silencing channel 288 is consistent with the target silencing length.

In this way, the silencing structure in the screw compressor 100 of this application can effectively reduce the exhaust pulsation in the discharge cavity 113, and can automatically adapt to different operating conditions to reduce a pulsation with prominent energy.

It should be noted that although the wall of the discharge cavity 113 is provided with the eight holes in this application, any number of holes and the number of its correspondingly disposed adjustment pistons are within the protection scope of this application.

The eight silencing channels 288 are formed in the silencing structure shown in FIG. 2 (only four silencing channels are shown in FIG. 2, and the other four silencing channels are not shown), and each of the eight silencing channels 288 has a same length, and can be configured to perform silencing on a wavelength band corresponding to the peak energy. Specifically, when sound waves matching the silencing length are transmitted to the inlet end of the silencing channel, most of the sound waves are reflected due to a mismatch of acoustic impedance, and some sound waves are converted into heat energy due to a damping action and absorbed, so that only a small part of the sound waves can further propagate downstream to achieve silencing. As can be seen from FIG. 1B, the plurality of silencing channels are arranged in two rows, and are disposed along a travel route of the sound waves (for example, from the communication port 112 to the outlet of the screw compressor 100). Compared with only one silencing channel, the plurality of silencing channels disclosed along the travel route of the sound waves in the screw compressor 100 of this application can perform a plurality of silencing on the same wavelength band, thus greatly reducing the noise produced by the gas discharged from the screw compressor 100.

Figure 7:
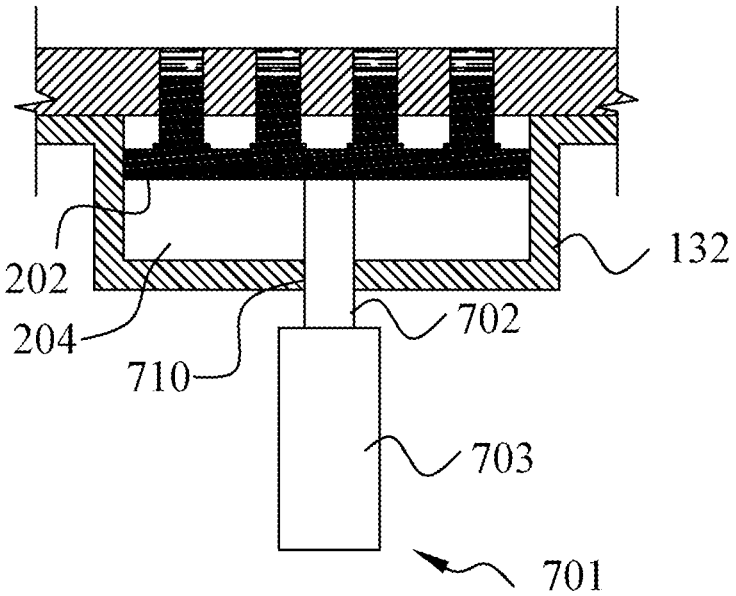
FIG. 7 is a schematic diagram of another embodiment of a drive mechanism of driving an adjustment slider and eight adjustment pistons.

FIG. 7 shows another embodiment of a drive mechanism of driving an adjustment slider 202 and eight adjustment pistons 222. The silencing structure shown in FIG. 7 is substantially the same as the silencing structure shown in FIG. 6, and the description will not be repeated here. The difference from that shown in FIG. 6 is that the adjustment slider 202 and the eight adjustment pistons 222 shown in FIG. 6 take the lubricant as a drive source, while the adjustment slider 202 and the eight adjustment pistons 222 shown in FIG. 7 take a driving apparatus 701 as a drive source. More specifically, in an embodiment shown in FIG. 6, the adjustment box 132 is provided with the communication port 134 for receiving the lubricant, and the movement of the adjustment slider 202 is controlled by controlling the lubricant accommodated in the second accommodation portion 232, thereby controlling the length of the silencing channel 288. This control method does not require an external power source, and the length of the silencing channel 288 can be controlled by using the lubricant in the refrigeration system 300, thereby reducing production cost and operation cost. While in an embodiment shown in FIG. 7, the movement of the adjustment slider 202 is controlled by the driving apparatus 701, thereby controlling the length of the silencing channel 288. In this control method, there are fewer piping arrangements, and the length of the silencing channel 288 can be directly controlled by the driving apparatus 701.

Specifically, the driving apparatus 701 includes a body 703 and a rod 702. The rod 702 can extend and retract from the body 703 relative to the body 703. The adjustment box 132 is provided with a receiving port 710 for receiving the rod 702 of the driving apparatus 701. The rod 702 extends from the receiving port 710 into the adjustment cavity 204. A distal end of the rod 702 is connected with the adjustment slider 202, so that when the rod 702 extends, the eight adjustment pistons 222 move towards the screw compressor housing 101 together with the adjustment slider 202, so that the length of the silencing channel 288 is reduced. When the rod 702 retracts, the eight adjustment pistons 222 move away from the screw compressor housing 101 together with the adjustment slider 202, so that the length of the silencing channel 288 is increased. As an example, the driving apparatus 701 is a motor. The controlling apparatus 301 is connected with the driving apparatus 701 in a communicating manner, thereby controlling start and stop of the driving apparatus 701.

Figure 8:
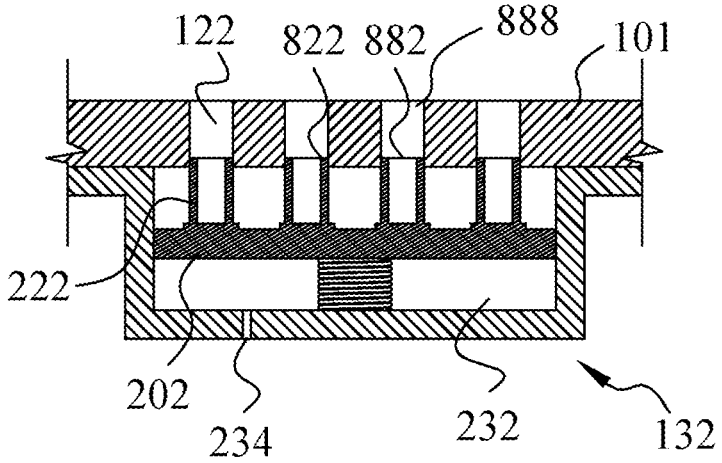
FIG. 8 is a cross-sectional view of a second embodiment of the silencing structure.

FIG. 8 shows a cross-sectional view of a second embodiment of a silencing structure. The similarities between the silencing structure shown in FIG. 8 and the silencing structure shown in FIG. 2 will not be repeated here. The difference from that shown in FIG. 2 is that each of the adjustment pistons 822 shown in FIG. 8 is provided with a blind hole 882. In other words, each of the adjustment pistons 822 is provided with a recess extending from one end surface to the other end. A diameter of the recess is slightly less than that of the adjustment piston 822. The silencing channel 888 is now formed jointly by parts of the eight holes 122 starting from the inlet end with the blind hole 882. When the adjustment piston 822 moves in the hole 122, a relatively long silencing length can be provided, thereby adapting to sound waves with a relatively long wavelength. More specifically, in an embodiment of the silencing structure as shown in FIG. 2, the length of the silencing channel 288 is determined by the distance from the inlet end to the top portion of the adjustment piston 222. The silencing structure is suitable for application scenarios where the wall thickness of the screw compressor housing 101 is relatively large, or the target silencing length is relatively short. While in an embodiment of the silencing structure as shown in FIG. 8, the silencing channel 888 is determined by the distance from the inlet end to a bottom of the recess of the adjustment piston. The silencing structure is suitable for application scenarios where the wall thickness of the screw compressor housing 101 is relatively small, or the target silencing length is relatively long, so as to reduce noise with a relatively long wavelength.

It should be noted that, when the length of the adjustment piston 822 is greater than that of the eight holes 122, the adjustment piston 822 can protrude inwards relative to an inner wall of the discharge cavity 113. The length of the silencing channel 888 is now determined by a depth of the blind hole 882 in the adjustment piston 822.

Figure 9:
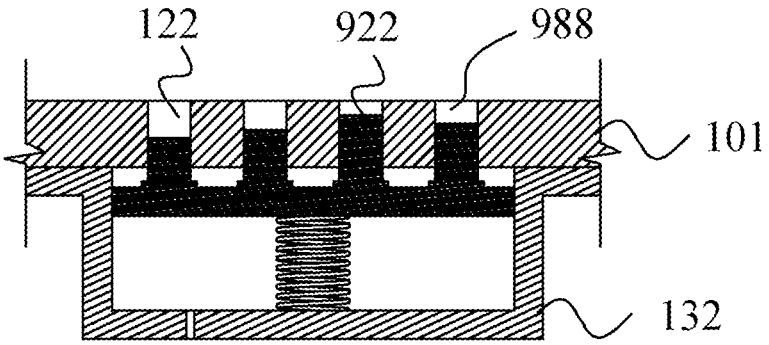
FIG. 9 is a cross-sectional view of a third embodiment of the silencing structure.

FIG. 9 shows a cross-sectional view of a third embodiment of a silencing structure. The similarities between the silencing structure shown in FIG. 9 and the silencing structure shown in FIG. 2 will not be repeated here. The difference from that shown in FIG. 2 is that lengths of the eight adjustment pistons 922 shown in FIG. 9 are different. Therefore, lengths of the eight silencing channels 988 are also different. The eight silencing channels 988 with different lengths can perform silencing on sound waves of different wavelengths, respectively, thereby realizing that pulsations of a plurality of frequencies with more prominent energy are reduced simultaneously, so as to widen a silencing range. As an example, the lengths of some of the eight silencing channels 988 in the embodiment shown in FIG. 9 can be designed to match the wavelength corresponding to the peak energy, thereby reducing noise at the peak energy. While the length of the remaining silencing channels 988 can be designed to match a wavelength near the peak energy, thereby reducing other noise near the peak energy.

Figure 10:
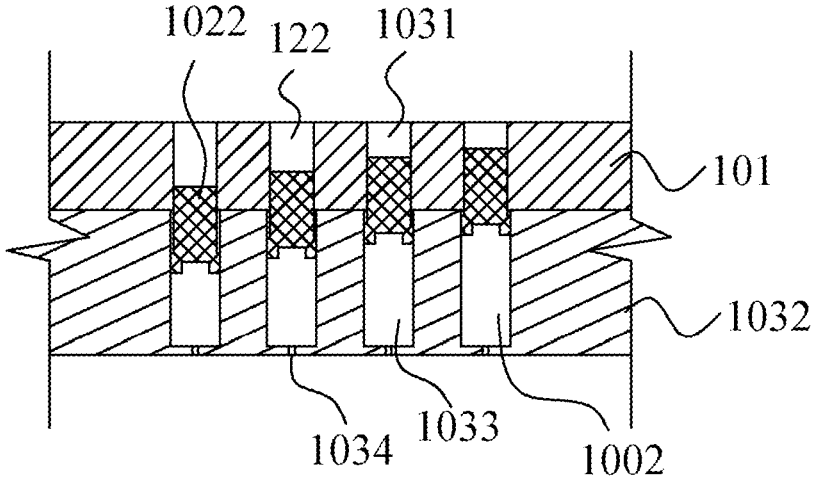
FIG. 10 is a cross-sectional view of a fourth embodiment of the silencing structure.

FIG. 10 shows a cross-sectional view of a fourth embodiment of a silencing structure. As shown in FIG. 10, the eight holes 122 are provided in the wall of the discharge cavity 113. Each of the eight holes 122 extends through the wall of the discharge cavity 113. The adjustment box 1032 is a cuboid, and eight adjustment cavities 1002 are disposed on the adjustment box. The eight adjustment cavities 1002 extend downwards from one side of the adjustment box 1032. The eight adjustment cavities 1002 are the same as the eight holes 122 in circumferential size, and are disposed in a one-to-one correspondence with the eight holes 122 so as to form a continuous channel. The eight adjustment pistons 1022 are each disposed in corresponding one of the eight channels, and divide each of the adjustment cavities 1002 into a first accommodation portion 1031 and a second accommodation portion 1033. The eight silencing channels are now formed by the eight holes 122 starting from the inlet end to the end surfaces of the adjustment pistons 1022. One side of the adjustment box 1032 opposite to the eight adjustment cavities 1002 is provided with eight communication ports 1034 corresponding to the second accommodation portion 1033 for being connected with the lubricant system so as to control the position of each adjustment piston 1022 in the channel. The eight communication ports 1034 are in fluid communication with the eight adjustment cavities 1002, respectively. The bottom portion of each adjustment piston 1022 is provided with a protrusion portion, and the protrusion portion serves as a limit for downward movement of each adjustment piston 1022. The refrigeration system may include a plurality of third channels, a plurality of fourth channels and a plurality of switching apparatuses corresponding to the number of adjustment pistons 1022 so as to control the position of each adjustment piston 1022 in the channels by using the lubricant in the lubricant circuit. A specific control method thereof is similar to that described in FIG. 3 to FIG. 5, and the description will not be repeated here. When the screw compressor 100 operates, the position of each adjustment piston 1022 in the channel can be independently controlled, thereby forming silencing channels with different silencing lengths. The silencing channels of different lengths can perform silencing on the noise of different wavelengths, and thereby, in addition to the wavelength corresponding to the peak energy, silencing can also be performed on wavelengths corresponding to other relatively high energy, broadening a silencing range.

The silencing structures shown in FIG. 2 to FIG. 10 above are each provided with the silencing channels on the inner wall of the discharge cavity 113. When the sound waves matching the silencing length are transmitted to the inlet end of the silencing channel, most of the sound waves are reflected due to the fact that the presence of the silencing channels causes an acoustic impedance mismatch, and some sound waves are converted into heat energy due to a damping action and absorbed, so that only a small part of the sound waves can further propagate forwards to achieve silencing. When the silencing length is different, sound waves at more frequency bands can be absorbed, thereby improving a silencing effect.

It should be understood that although the eight holes are provided in the wall of the discharge cavity 113 in this application, any number of holes and the number of its correspondingly disposed adjustment pistons are within the protection scope of this application.

Figure 11:
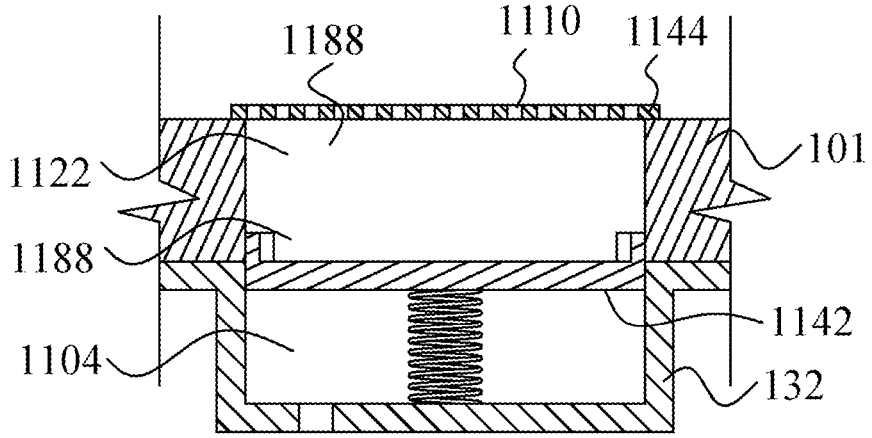
FIG. 11 is a cross-sectional view of a fifth embodiment of the silencing structure.

FIG. 11 shows a cross-sectional view of a fifth embodiment of the silencing structure. As shown in FIG. 11, a square hole 1122 is provided in the screw compressor housing 101. The width of the hole 1122 is approximately the sum of diameters of the eight holes 122 in the embodiment shown in FIG. 2. The adjustment cavity 1104 of the adjustment box 132 communicates with the hole 1122 and forms a continuous channel. An adjustment piston 1142 is disposed in the continuous channel and can move in the continuous channel. The silencing channel 1188 is now formed by the hole 1122 starting from the inlet end to the end surface of the adjustment piston 1142. When the adjustment pistons 1142 move in the continuous channel, different silencing lengths can be formed.

A plate 1144 is further disposed in the discharge cavity 113. The plate 1144 is provided with a several perforations 1110. The plate 1144 covers the hole 1122 and thereby covers the inlet end of the silencing channel 1188, so that the sound waves can pass through the several perforations 1110 and enter the channel formed by the adjustment cavity 1104 and the hole 1122. The perforations 1110 in the plate 1144 and the channels form a silencing structure. When the sound waves matching the silencing length are transmitted to the vicinity of the perforations 1110, most of the sound waves are reflected due to the fact that the presence of the silencing channels causes an acoustic impedance mismatch, and some sound waves are converted into heat energy due to a damping action and absorbed, so that only a small part of the sound waves can further propagate forwards to achieve silencing.

Figure 12:
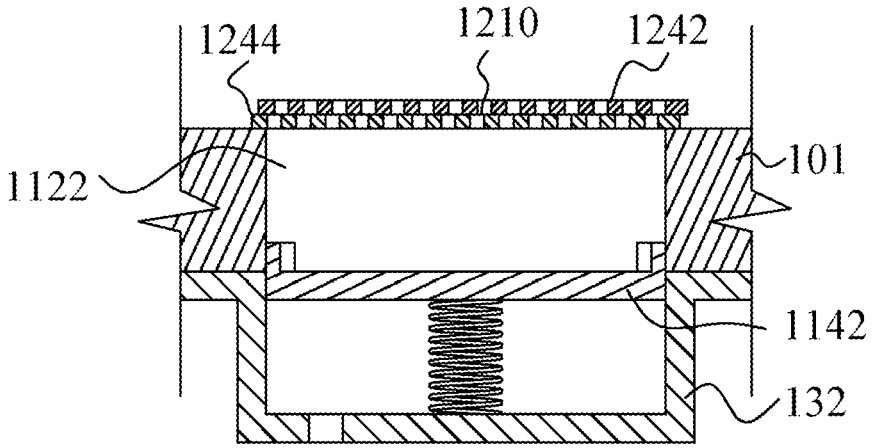
FIG. 12 is a cross-sectional view of a sixth embodiment of the silencing structure.

FIG. 12 shows a cross-sectional view of a sixth embodiment of a silencing structure. The embodiment shown in FIG. 12 is substantially the same as the embodiment shown in FIG. 11, and the description will not be repeated here. The difference from the embodiment shown in FIG. 11 is that the discharge cavity 113 of the embodiment shown in FIG. 12 is provided with two plates 1242 and 1244. Several perforations are disposed in each of the two plates 1242 and 1244. The two plates 1242 and 1244 can move relative to each other, thereby changing alignment area of the several perforations. Aligned parts of the two plates 1242 and 1244 form an additional silencing channel, so that the discharge cavity 113 can communicate with the silencing channel 1188 through the several perforations. By changing the area of the additional silencing channel, the pulsation wavelength mainly silenced by this silencing structure can be changed, thereby matching and reducing the peak energy under different operating conditions.

It should be noted that although the two plates are shown in this application, any number of plates are within the protection scope of this application, as long as the additional silencing channel can be formed between the plates.

Thus, this application provides a screw compressor, and the length of the silencing channel can be automatically adjusted according to the operating conditions (for example, the operating frequency, the exhaust temperature and the exhaust pressure) of the screw compressor, thereby effectively reducing the peak energy of exhaust pulsation under different operating conditions, reducing the noise.

In addition, the silencing structure of this application forms a portion of the silencing channel by providing holes in the inner wall, so that the silencing structure is small in size and compact in layout. This silencing structure does not increase flow resistance of the airflow and is easy to manufacture.

Although only some of the features of this application have been illustrated and described herein, various modifications and changes will occur to those skilled in the art. It is therefore to be understood that the appended claims are intended to cover all the above modifications and changes falling within the true spirit and scope of this application.

What is claimed is:

1. A screw compressor, comprising:

a screw compressor housing;

a discharge cavity, the discharge cavity being defined by at least one part of the screw compressor housing, the at least one part of the screw compressor housing defining the discharge cavity forming a wall of the discharge cavity, and at least two holes being provided in the wall of the discharge cavity;

at least two adjustment pistons each configured to be inserted into a respective hole of the at least two holes and to move therein; and at least two silencing channels, the at least two silencing channels being formed by the at least two holes and the at least two adjustment pistons, and the at least two silencing channels being in fluid communication with the discharge cavity, wherein a respective position of each of the at least two adjustment pistons in the respective hole determines a silencing length of a respective silencing channel of the at least two silencing channels;

wherein the screw compressor further comprises an adjustment slider, and the at least two adjustment pistons are connected to the adjustment slider; and wherein the adjustment slider and the at least two adjustment pistons are configured such that each of the at least two adjustment pistons can do reciprocating movement in the respective silencing channel when the adjustment slider does reciprocating movement relative to the screw compressor housing, thereby changing the silencing length of each of the at least two silencing channels.

2. The screw compressor according to claim 1, wherein:

the at least two adjustment pistons can do the reciprocating movement relative to the screw compressor housing independently of each other.

3. The screw compressor according to claim 1, wherein:
the at least two adjustment pistons are configured such that each of the at least two silencing channels has a different silencing length at any moment when the at least two adjustment pistons do reciprocating movement relative to the screw compressor housing.

4. The screw compressor according to claim 1, wherein:
the at least two holes are each is provided with an inlet end and a distal end opposite to the inlet end, and configured to receive a respective one of the at least two adjustment pistons from the distal end; and
a distance between a top portion of the respective one of the at least two adjustment pistons and the inlet end is the silencing length.

5. The screw compressor according to claim 1, wherein:
the at least two holes are each is provided with an inlet end and a distal end opposite to the inlet end, and configured to receive a respective one of the at least two adjustment pistons from the distal end; and
the respective one of the at least two adjustment pistons is provided with a recess extending from an end surface of one end of the respective one of the at least two adjustment positions to another end thereof, and a distance between a bottom of the recess and the inlet end is the silencing length.

6. The screw compressor according to claim 1, wherein:
the screw compressor further comprises an adjustment box, the adjustment box being arranged on an outer side of the screw compressor housing and defining an adjustment cavity; and
the adjustment slider is disposed in the adjustment box and divides the adjustment cavity into a first accommodation portion and a second accommodation portion, the first accommodation portion is formed on one side of the adjustment slider close to the screw compressor housing, and the second accommodation portion is formed between the adjustment box and the adjustment slider.

7. A screw compressor, comprising:
a screw compressor housing;
a discharge cavity, the discharge cavity being defined by at least one part of the screw compressor housing, the at least one part of the screw compressor housing defining the discharge cavity forming a wall of the discharge cavity, and a hole is provided in the wall of the discharge cavity;
an adjustment box, the adjustment box being arranged on an outer side of the screw compressor housing and defining an adjustment cavity, and the adjustment cavity and the hole forming a continuous channel;
an adjustment piston configured to be inserted into the continuous channel and move therein; and
a silencing channel, the silencing channel being formed by the hole, the adjustment piston and the adjustment box, and the silencing channel being in fluid communication with the discharge cavity,
wherein a position of the adjustment piston in the hole and the adjustment cavity determines a silencing length of the silencing channel.

8. The screw compressor according to claim 7, wherein:
the screw compressor further comprises at least one plate, the at least one plate being arranged in the discharge cavity and covering the hole; and
the at least one plate is provided with a plurality of perforations configured to place the discharge cavity in fluid communication with the silencing channel.

9. The screw compressor according to claim 7, wherein:
the adjustment piston is disposed in the adjustment box, and divides the adjustment cavity into a first accommodation portion and a second accommodation portion, the first accommodation portion is formed on one side of the adjustment piston close to the screw compressor housing, and the second accommodation portion is formed between the adjustment box and the adjustment piston.

10. A refrigeration system, comprising:
the screw compressor according to claim 7; and
a lubricant circuit, the lubricant circuit being connected to the screw compressor,
wherein the second accommodation portion communicates with the lubricant circuit in a closable manner and communicates with an inlet of the screw compressor in a closable manner;
and wherein the refrigeration system is configured to supply a lubricant from the lubricant circuit to the second accommodation portion to cause each of the at least two adjustment pistons to move towards a respective inlet end of each of the at least two holes and configured to introduce the lubricant in the second accommodation portion into the inlet of the screw compressor to cause each of the at least two adjustment pistons to move away from the respective inlet end.

11. The screw compressor according to claim 2, wherein:
the at least two adjustment pistons are configured such that each of the at least two silencing channels has a different silencing length at any moment when the at least two adjustment pistons do reciprocating movement relative to the screw compressor housing.

12. A screw compressor, comprising:
a screw compressor housing;
a discharge cavity, the discharge cavity being defined by at least one part of the screw compressor housing, the at least one part of the screw compressor housing defining the discharge cavity forming a wall of the discharge cavity, and at least two holes being provided in the wall of the discharge cavity;
at least two adjustment pistons each configured to be inserted into a respective hole of the at least two holes and to move therein; and
at least two silencing channels, the at least two silencing channels being formed by the at least two holes and the at least two adjustment pistons, and the at least two silencing channels being in fluid communication with the discharge cavity,
wherein a respective position of each of the at least two adjustment pistons in the at least two holes determines a silencing length of a respective silencing channel of the at least two silencing channels; and
wherein the at least two adjustment pistons can do reciprocating movement relative to the screw compressor housing independently of each other, thereby changing the silencing length of each of the at least two silencing channels.

13. A screw compressor, comprising:
a screw compressor housing;
a discharge cavity, the discharge cavity being defined by at least one part of the screw compressor housing, the at least one part of the screw compressor housing defining the discharge cavity forming a wall of the discharge cavity, and at least one hole being provided in the wall of the discharge cavity;
at least one adjustment piston configured to be inserted into the at least one hole and move therein; and at least one silencing channel, the at least one silencing channel being formed by the at least one hole and the at least one adjustment piston, and the at least one silencing channel being in fluid communication with the discharge cavity, wherein a position of the at least one adjustment piston in the at least one hole determines a silencing length of the at least one silencing channel;

wherein the at least one hole is provided with an inlet end and a distal end opposite to the inlet end, and the at least one adjustment piston is configured to be inserted into the at least one hole from the distal end; and wherein the at least one adjustment piston is provided with a recess extending from an end surface of one end of the at least one adjustment piston to another end, and a distance between a bottom of the recess of the at least one adjustment piston and the inlet end is the silencing length.

* * * * *